US007641085B2

(12) United States Patent
Nickels

(10) Patent No.: US 7,641,085 B2
(45) Date of Patent: Jan. 5, 2010

(54) COMBINATION UMBRELLA, SUPPORT AND METHOD OF USE

(76) Inventor: Dorothy Shook Nickels, 635 W. King St., Orlando, FL (US) 32804

( * ) Notice: Subject to any disclaimer, the term of this patent is extended or adjusted under 35 U.S.C. 154(b) by 0 days.

(21) Appl. No.: 11/942,194

(22) Filed: Nov. 19, 2007

(65) Prior Publication Data

US 2008/0116236 A1 May 22, 2008

Related U.S. Application Data

(60) Provisional application No. 60/866,472, filed on Nov. 20, 2006.

(51) Int. Cl.
*A45B 11/02* (2006.01)
*A45F 3/04* (2006.01)
*A45F 3/14* (2006.01)

(52) U.S. Cl. ..... 224/190; 224/188; 224/651; 224/250

(58) Field of Classification Search ..... 224/190, 224/149, 103, 188, 651, 250, 915
See application file for complete search history.

(56) References Cited

U.S. PATENT DOCUMENTS 1,347,540 A * 7/1920 Godard ..... 224/190
1,657,263 A * 1/1928 Lauby ..... 224/188
2,434,526 A 1/1948 Thornton
2,496,769 A 2/1950 Battle
3,204,650 A 9/1965 Shinew
3,498,511 A * 3/1970 Marg ..... 224/149
3,554,203 A 1/1971 Hall
4,188,965 A 2/1980 Morman
4,537,339 A * 8/1985 Pearson ..... 224/188
5,263,837 A * 11/1993 Dompe ..... 224/190
5,353,977 A * 10/1994 Schiro et al. ..... 224/251
5,513,786 A * 5/1996 Drane ..... 224/188
5,664,721 A * 9/1997 Homeyer ..... 224/651
5,873,486 A * 2/1999 Morgan ..... 220/739
5,887,771 A 3/1999 Perry
5,918,612 A * 7/1999 Hughes ..... 135/16

(Continued)

FOREIGN PATENT DOCUMENTS

EP GB2352969 A * 2/2001

(Continued)

*Primary Examiner*—Nathan J Newhouse
*Assistant Examiner*—Lester L Vanterpool
(74) *Attorney, Agent, or Firm*—Allen Dyer Doppelt Milbrath & Gilchrist

(57) ABSTRACT

An umbrella support device includes a halter strap formed as a loop having a connection point formed thereon for attachment to a belt, an umbrella cup attached to the halter strap proximate to the connection point for receiving an umbrella handle therein, and an umbrella stabilizer attached to the halter strap at a point furthest from the umbrella cup for accommodating an umbrella pole therethrough. A method of donning the umbrella support device includes placing the halter strap over a user's first shoulder, placing the halter strap over the user's second shoulder, such that the halter strap extends behind the user's neck, in front of the user's shoulders, under the user's arms and across the user's back, and orienting the halter strap such that the umbrella cup is approximately centered across the user's back and the umbrella stabilizer is approximately centered behind the user's neck.

3 Claims, 5 Drawing Sheets

U.S. PATENT DOCUMENTS

| | | | | |
|---|---|---|---|---|
| 6,024,464 | A * | 2/2000 | De Vera | 362/102 |
| 6,619,520 | B2 * | 9/2003 | Hammond | 224/188 |
| 6,619,521 | B2 * | 9/2003 | Hadley | 224/190 |
| 6,926,018 | B1 * | 8/2005 | Ryo | 135/15.1 |

FOREIGN PATENT DOCUMENTS

| | | | |
|---|---|---|---|
| JP | 02002282035 | A * | 10/2002 |
| JP | 02004016793 | A * | 1/2004 |

* cited by examiner

COMBINATION UMBRELLA, SUPPORT AND METHOD OF USE

CROSS REFERENCE TO RELATED APPLICATIONS

This application claims the benefit of U.S. Provisional Application Ser. No. 60/866,472, filed on Nov. 20, 2006, the contents of which are herein incorporated by reference in their entirety.

FIELD OF THE INVENTION

This invention relates to an apparatus and a related method for allowing a user to use an umbrella without having to carry it in his or her hands.

BACKGROUND

Although umbrellas provide protection for the user in instances of sun, rain, sleet and even light snowfall, it is difficult to use an umbrella while performing tasks outdoors that require the use of both hands to be efficient. Moreover, carrying an umbrella when not in use is awkward. Over the years, various forms of hands free rain wear protection have been developed, but they are all awkward to carry or burdensome to wear. The stadium umbrella hat serves the criterion for being hands free, but it is awkward to carry, and is not likely to stay in place when the user is performing tasks of a physical nature or when the user is exposed to wind.

Some examples of early attempts at umbrella supports are described in U.S. Pat. Nos. 2,434,526, 2,496,769 and 3,204,650. These devices all require specially adapted umbrellas, and involve substantial use of rigid harness components that cannot be easily collapsed and stored. Moreover, these devices are extremely obtrusive, even when not holding an umbrella, making it difficult to sit or move naturally.

U.S. Pat. Nos. 3,554,203 and 4,188,965 describe devices that attempt to accommodate conventional umbrellas. However, the device shown in the '203 patent still utilizes a large, rigid back framework, rendering movements awkward and preventing easy storage of the device when not in use. The '965 patent requires extensive modifications to be made to the shaft of an umbrella before it can be used with the support device, and also required a large and unwieldy belt assembly, including a rigid metal plate and various pins and springs. Thus, this device is also obtrusive and difficult to store when in use, and an obstacle to normal movement when not in use.

A more recent approach to a hands-free umbrella support is described in U.S. Pat. No. 6,619,520. The device shown in the '520 patent does not utilize rigid components, but does require a relatively large amount of material and is very obtrusive, particularly when viewed from the front, whether or not an umbrella is supported therein. Additionally, the device of the '520 patent makes no provision for inhibiting lateral movement of the umbrella pole in response to wind, and positions the umbrella with at a significant rearward angle. Thus, in many situations a greatly diminished protection from the elements may result.

SUMMARY OF THE INVENTION

Therefore, it is an object of the present invention to provide a hands-free, light-weight apparatus that is collapsible so that it may be carried in a purse or pocket when it is not being used by the user, is unobtrusive when worn, and does not inhibit the normal movement of the user. Ideally, the apparatus can be used with a conventional umbrella and should not subject the user to excessive pressure when carrying the weight of the umbrella on the user's shoulders or back.

According to an embodiment of the present invention an umbrella support device includes a halter strap formed as a loop having a connection point formed thereon for attachment to a belt, an umbrella cup attached to the halter strap proximate to the connection point for receiving an umbrella handle therein, and an umbrella stabilizer attached to the halter strap at a point furthest from the umbrella cup for accommodating an umbrella pole therethrough. According to an aspect of the present invention, the umbrella cup includes a fastener, such as a portion of a hook and loop fastener, for removably attaching the umbrella handle therein. In a kit, a complementary portion of the hook and loop fastener is included for attachment to the umbrella handle.

According to another embodiment of the present invention, a method of donning the umbrella support device includes placing the halter strap over a user's first shoulder, placing the halter strap over the user's second shoulder such that the halter strap extends behind the user's neck, in front of the user's shoulders, under the user's arms and across the user's back. The method further includes orienting the halter strap such that an umbrella cup attached the halter strap is approximately centered across the user's back and an umbrella stabilizer attached to the halter strap is approximately centered behind the user's neck.

Some of the features, advantages, and benefits of the present invention having been stated, others will become apparent as the description proceeds when taken in conjunction with the accompanying drawings, presented solely for exemplary purposes and not with an intent to limit the invention thereto.

DETAILED DESCRIPTION OF A PREFERRED EMBODIMENT

The present invention will now be described more fully hereinafter, in which description preferred embodiments of the invention are discussed. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description.

Figure 1:
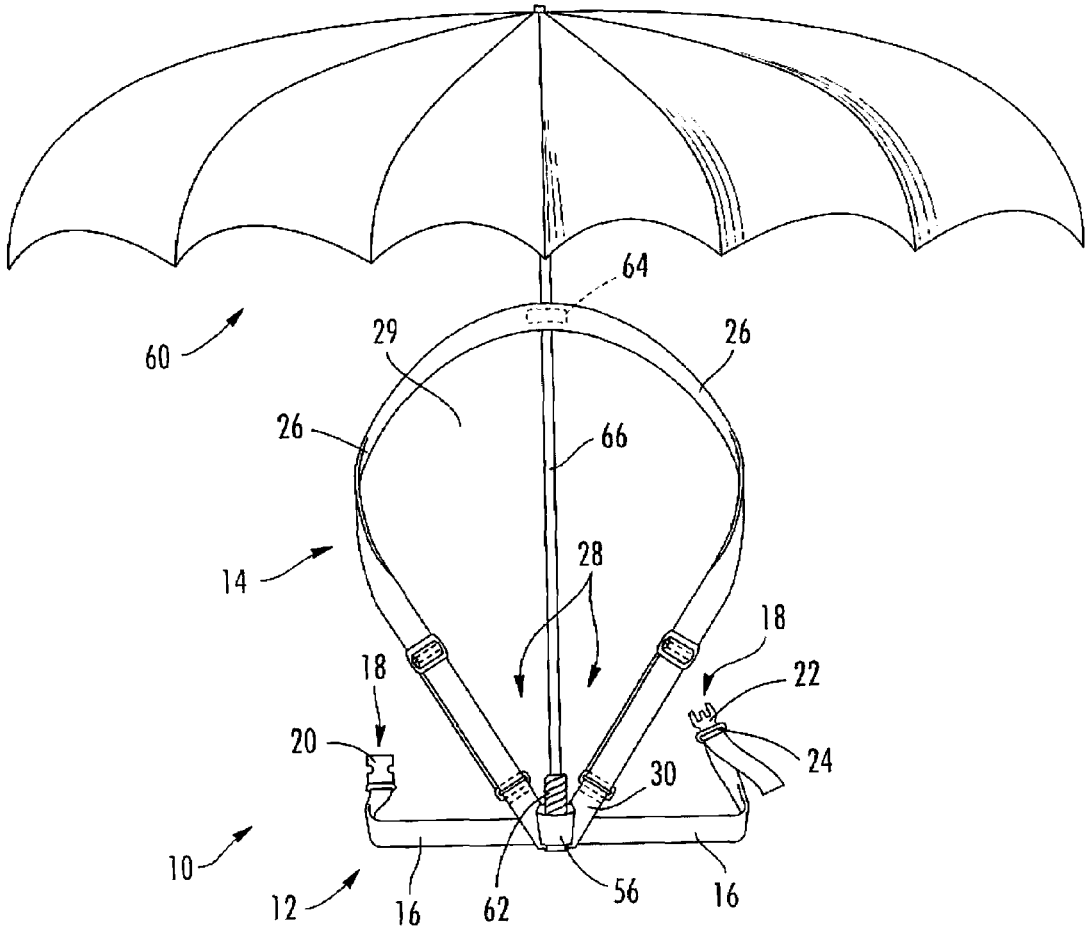
FIG. 1 is a view of a hands free umbrella holder with the umbrella mounted therein according to an embodiment of the present invention.

The invention comprises an umbrella support device 10, as shown in FIG. 1. The umbrella support device 10 has an adjustable belt 12 and an adjustable halter strap 14. The belt 12 comprises a single strap 16 with an adjustable connector 18 having a fixed connection to a receiving portion 20 of the connector and a strap adjustment feature 22 attached to an insertion portion 24 of the connector. The adjustment feature 22 is used to lengthen or shorten the belt strap 16 so that it may be comfortably secured around the user's waist. The connector 18 may be made of either a light weight metal or plastic. Because of its corrosion resistance, plastic is preferable as oxidation is likely to cause the belt material to degrade over time.

Figure 2:
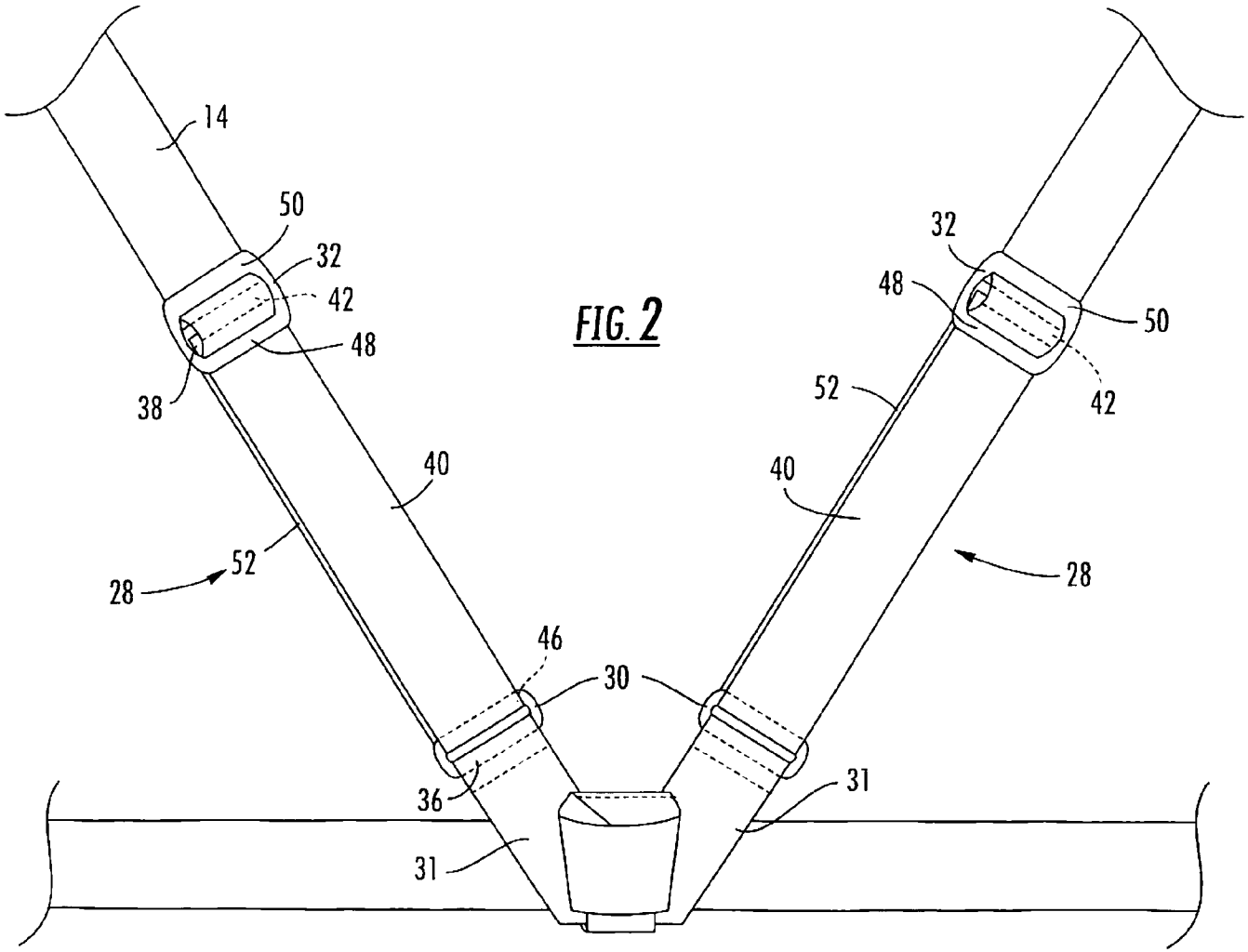
FIG. 2 is a view of a halter strap showing how the adjusting fasteners are used to adjust the strap length according to an embodiment of the present invention.

The halter strap 14 comprises at least one strap 26 that in a preferred embodiment forms a loop 29 that is adjustable by having one or more strap adjusting fasteners 28 that are located near both ends of the halter strap loop just above the point where the halter strap attaches to the belt. As shown in FIG. 2, these strap adjusting fasteners 28 each comprise a simple loop holder 30 to which a substantially v-shaped folded portion 31 of the halter strap 14 is fixed to a first loop holder 30 on a lower bar 36. A first end 38 of a second portion 40 of the halter strap 14 is fixed to a central bar 42 of an l-shaped loop holder 32. The second portion 40 of the halter strap 14 is then looped around an upper bar 46 of the loop holder 30, and then laced under the lower bar 48 of the l-shaped loop holder 32 and up through an opening created between a lower bar 48 and the central bar 42. The halter strap 14 is then inserted into a second opening created between the central bar 42 and the upper bar 50 of the l-shaped loop holder 32. By configuring the halter strap adjusting fasteners 28 in this manner, the fabric loop 52 that is created between the loop holder 30 and l-shaped loop holder 32 may be used to adjust the length of the halter strap 14 by increasing or decreasing the size of the loop 52. In this manner, the halter strap 14 may be adjusted to suit the comfort of the user.

Figure 3:
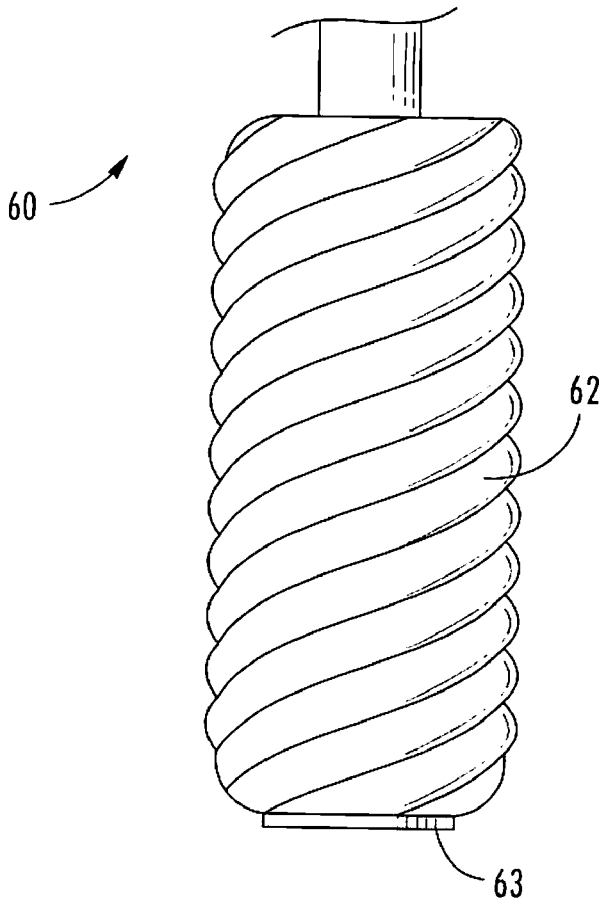
FIG. 3 is an exploded view of an umbrella cup according to an embodiment of the present invention.
Figure 3:
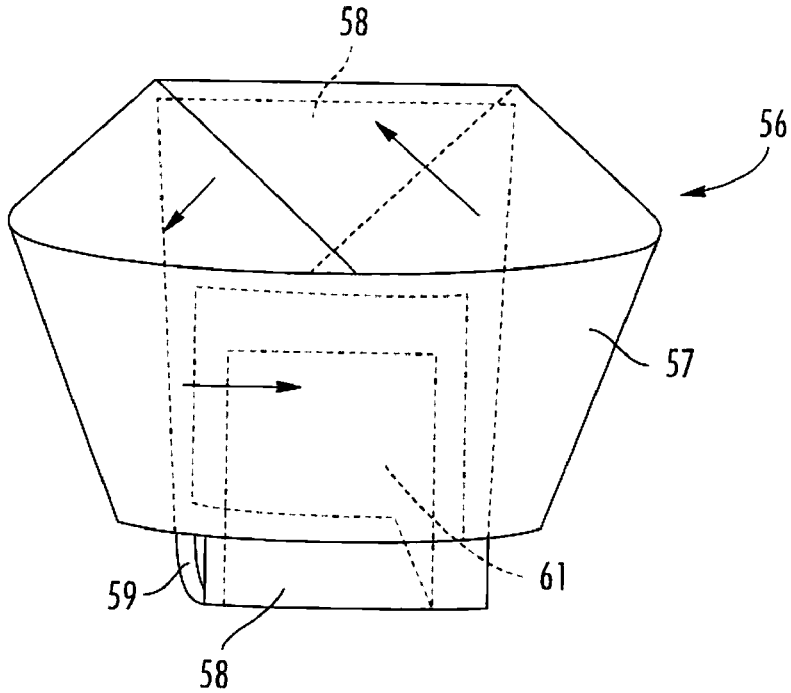

An umbrella cup 56 is located at the point of connection 54 of the belt 12 and the halter strap 14. The umbrella cup 56 may be a plastic cup suitable for holding the end of an umbrella handle, but will preferably be a cloth or plastic piece made of the same material as the halter strap 14 and belt 12 so that it is fully collapsible when not in use. A cloth umbrella cup 56 may be created using two separate pieces of strap materials as shown in FIG. 3. A first strip 57 is folded to form a trapezoidal-shaped cup that is attached to a second piece 58 which forms a loop 59 for slidably attaching the umbrella cup 56 to the belt 12. The trapezoidal shape, as well as a slight give in the construction, is useful to accommodate umbrella handles of different diameters.

To add further support for an umbrella 60, a fastener, such as a portion 61 of a hook and loop fastener (e.g., Velcro®), is added to the inside of the umbrella cup 56. To provide greatly enhanced stability and assistance in holding the umbrella 60 in place, an umbrella handle 62 is attached to a complementary portion 63 of the hook and loop fastener. This portion is preferably included in a kit with the support device 10. By way of non-limiting example, the fastener 61 may be a snap, a hook and loop fastener, or any other mechanical connector that is suitable for this purpose. The portion 63 attached to the portion 61 in the bottom of the umbrella cup 56 then securely holds the umbrella 60 into the umbrella cup 56, preventing rotation and detachment of the umbrella 60 even in a windy environment.

Referring again to FIG. 1, on the halter strap 14, at the point furthest from the umbrella cup 56, is an umbrella stabilizer 64 for holding the pole 66 of the umbrella 60 in place while in use. While those skilled in the art will recognize that the stabilizer 64 may consist of a strip of material that is snapped or hooked in place, in a preferred embodiment, a strap with a hook and loop fastener is preferred so that the stabilizer 64 may be easily fastened by the user. The stabilizer 64 may reside on either side of the halter strap 14, but is preferably worn on the inside of the halter strap against the user's neck for greater stability in holding the umbrella 60 in place under windy conditions.

To assure the invention is light-weight, both the belt 12 and the halter strap 14 may be made of conventional cloth, coated cloth, plastic or Gortex strapping, webbing, or the like, that can be folded and carried in a pocket or purse and unfolded for use. A small carrying pouch or case is also contemplated for holding the umbrella support device 10 when it is not in use.

Figure 4:
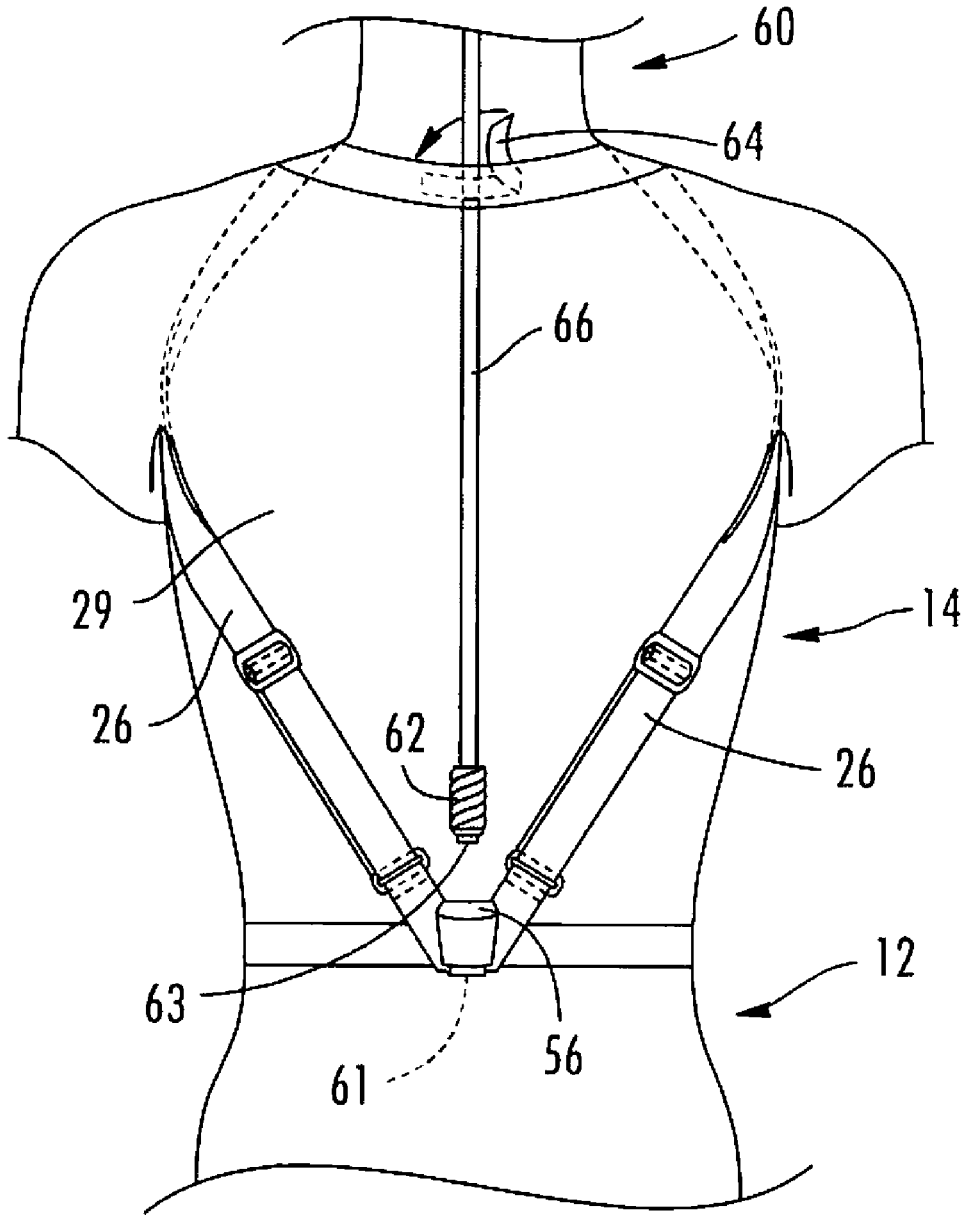
FIG. 4 is a back view of the umbrella holder as worn showing the umbrella support, a stabilizer, and a plurality of adjusting fasteners according to an embodiment of the present invention.
Figure 5:
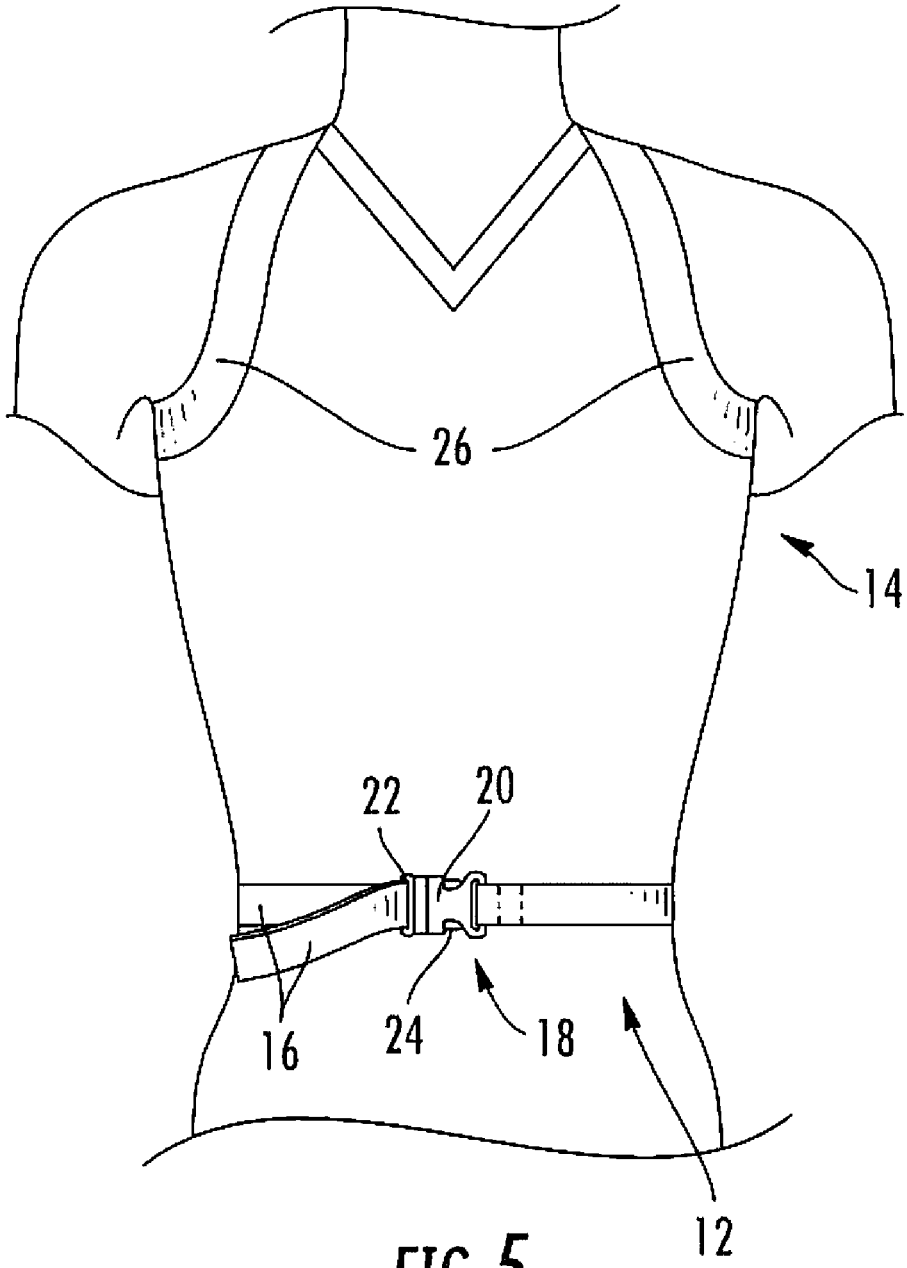
FIG. 5 is a frontal view of the umbrella holder depicting how the halter is worn over the shoulders and showing an adjustable belt connector according to an embodiment of the present invention.

In operation, the umbrella support device 10 is first removed from its carrying pouch, if one is provided, and unfolded. The halter strap 14 is then adjusted so that it can fit snugly, but comfortably on the user. Once adjusted, the strap should be customized for the user. Referring FIGS. 4 and 5, one arm is placed in the loop 29, and then the other arm is placed in the loop 29, such that the halter strap 14 extends behind the user's neck, in front of the user's shoulders, under the user's arms and across the user's back. The halter strap 14 should be oriented such that the umbrella cup 56 is approximately centered across the user's back and the stabilizer strap 64 is approximately centered behind the user's neck.

The device should rest comfortably under the arms and on the shoulders so that the stabilizer strap 64 faces the neck. The stabilizer strap 64 may then be unhooked, if it is not already undone, so that it is loose and available for use once the umbrella 60 is slid into place. The belt 12 is then drawn around the waist, fastened and adjusted as required using connector 18. The belt 12 and halter strap 14 are preferably adjusted for a snug fit. An umbrella 60 is then slipped into place under the halter strap 14 at the user's neck, with a terminal end of an umbrella handle 62 resting in the umbrella cup 56, such that the fastener portion 61 and the complementary portion 63 engage. The user then re-attaches the stabilizer strap 64 around the user's neck to hold the umbrella pole 66 in place.

It will be appreciated from the foregoing, that an umbrella support according to the present invention is formed with less material and an extremely low profile relative to prior art umbrella holders. Furthermore, the umbrella support device 10 does not require a bulky, rigid apparatus to immobilize the umbrella, is completely collapsible, and can be easily stored in a purse, bag or backpack when not use. With the exception of buckles and slides, the entire umbrella support device can be formed almost entirely of webbing or other fabrics, greatly facilitating manufacturing and distribution, and minimizing the shelf space required for display. When worn, the umbrella support device is relatively unobtrusive, exhibiting from the front only relatively small sections of the halter strap 14 and the belt 12. Alternately, the halter strap 14 can be connected to a conventional belt, further reducing visible indicia that the umbrella support device is being worn. Also, the umbrella support device can be comfortably worn under outerwear, such as a shirt or jacket, without or without an umbrella in place. Additionally, the umbrella support device does not require a special umbrella, and can be used with the large majority of conventional umbrella designs without requiring substantial modifications thereto.

In the specification there have been disclosed preferred embodiments of the invention, and although specific terms are employed, terms are used in a descriptive sense only and not for purposes of limitation. The invention has been described in some detail, but it will be apparent that various modifications and changes can be made within the spirit and scope of the invention as described in the foregoing specification and as defined in the appended claims.

What is claimed is:

1. A method of donning an umbrella support device, the method comprising steps of:

placing a halter strap over a user's first shoulder, the halter strap being formed as a loop;

placing the halter strap over the user's second shoulder, such that the halter strap extends behind the user's neck, in front of the user's shoulders, under the user's arms and across the user's back; and orienting the halter strap such that an umbrella cup attached the halter strap is approximately centered across the user's back and an umbrella stabilizer attached to the halter strap is approximately centered against the user's neck between the user's neck and the halter strap;

inserting an umbrella handle between the user's neck and the halter strap and into the umbrella cup such that the first hook and loop fastener portion in the umbrella cup engages a second, complementary hook and loop fastener portion on the umbrella handle;

fastening the umbrella stabilizer around an umbrella pole, such that the umbrella stabilizer is between the umbrella pole and the user's neck.

2. The method of claim 1, further comprising a step of fastening a belt connected to the halter strap proximate to the umbrella cup around the user's waist.

3. The method of claim 1, wherein the step of orienting the halter strap further includes orienting the halter strap such that the umbrella cup extends from the halter strap away from the user's back.

* * * * *